US006356239B1

(12) United States Patent
Carson

(10) Patent No.: US 6,356,239 B1
(45) Date of Patent: Mar. 12, 2002

(54) METHOD FOR MAINTAINING INSTANTANEOUS BANDWIDTH FOR A SEGMENTED, MECHANICALLY AUGMENTED PHASED ARRAY ANTENNA

(75) Inventor: Ronald Steven Carson, Renton, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/644,328

(22) Filed: Aug. 23, 2000

(51) Int. Cl.[7] ..... H01Q 3/10

(52) U.S. Cl. ..... 343/765; 343/757; 343/766; 342/375

(58) Field of Search ..... 343/709, 710, 343/711, 754, 761, 765, 766, 882, 757; 342/367, 368, 375, 376; 248/183

(56) References Cited

U.S. PATENT DOCUMENTS

| | | | | | |
|---|---|---|---|---|---|
| 3,972,045 | A | | 7/1976 | Perret | 343/708 |
| 4,392,139 | A | | 7/1983 | Aoyama et al. | 343/705 |
| 4,743,906 | A | | 5/1988 | Fullerton | 342/27 |
| 4,866,515 | A | | 9/1989 | Tagawa et al. | 358/86 |
| 4,901,307 | A | | 2/1990 | Gilhousen et al. | 370/18 |
| 4,958,381 | A | | 9/1990 | Toyoshima | 455/4 |
| 5,127,021 | A | | 6/1992 | Schreiber | 375/1 |
| 5,146,234 | A | | 9/1992 | Lalezari | 343/895 |
| 5,230,076 | A | | 7/1993 | Wilkinson | 455/62 |
| 5,249,303 | A | | 9/1993 | Goeken | 455/134 |
| 5,285,470 | A | | 2/1994 | Schrieber | 375/1 |
| 5,289,272 | A | | 2/1994 | Rabowsky et al. | 348/8 |
| 5,311,302 | A | | 5/1994 | Berry et al. | 348/14 |
| 5,313,457 | A | | 5/1994 | Hostetter et al. | 370/18 |
| 5,463,656 | A | | 10/1995 | Polivka et al. | 375/200 |
| 5,495,258 | A | | 2/1996 | Muhlhauser et al. | 343/753 |
| 5,517,204 | A | * | 5/1996 | Murakoshi et al. | 343/765 |
| 5,524,272 | A | | 6/1996 | Podowski et al. | 455/3.2 |
| 5,555,466 | A | | 9/1996 | Scribner et al. | 348/8 |
| 5,568,484 | A | | 10/1996 | Margis | 370/85.5 |
| 5,583,735 | A | | 12/1996 | Pease et al. | 361/170 |
| 5,760,819 | A | | 6/1998 | Sklar et al. | 348/8 |
| 5,790,175 | A | | 8/1998 | Sklar et al. | 348/8 |
| 5,801,751 | A | | 9/1998 | Sklar et al. | 348/8 |
| 6,034,634 | A | | 3/2000 | Karrisson et al. | 342/359 |
| 6,034,643 | A | * | 3/2000 | Nishikawa et al. | 343/765 |
| 6,047,165 | A | | 4/2000 | Wright et al. | 455/66 |
| 6,104,914 | A | | 8/2000 | Wright et al. | 455/66 |
| 6,108,523 | A | | 8/2000 | Wright et al. | 455/66 |
| 6,218,999 | B1 | * | 4/2001 | Bousquet et al. | 343/765 |

* cited by examiner

*Primary Examiner*—Tan Ho
(74) *Attorney, Agent, or Firm*—Harness Dickey & Pierce P.L.C.

(57) ABSTRACT

A system and method for positioning an electronically scanned, phased array antenna disposed on a moving platform, such as an aircraft, to enable the antenna to remain pointed at, and track, a geostationary satellite as the moving platform is in motion. The antenna is mounted on a support which is coupled to an output shaft of a motor. The motor is used to rotate the support, and therefore the antenna, as needed to maintain the beam of the antenna directed at the satellite. The support is rotated only after a scan angle of the beam of the antenna exceeds a predetermined maximum scan angle. The degree of rotational movement of the support is further selected to be such that only a minimum number of adjustments to the position of the support are needed to maintain the scan angle of the beam of the antenna within the desired maximum scan angle over a large distance of travel of the aircraft. The invention significantly reduces the frequency of adjustment of the position of the support required to maintain the antenna directed at the desired satellite, and thus significantly reduces wear and tear on the motor without adversely affecting the antenna's ability to track a target satellite.

16 Claims, 1 Drawing Sheet

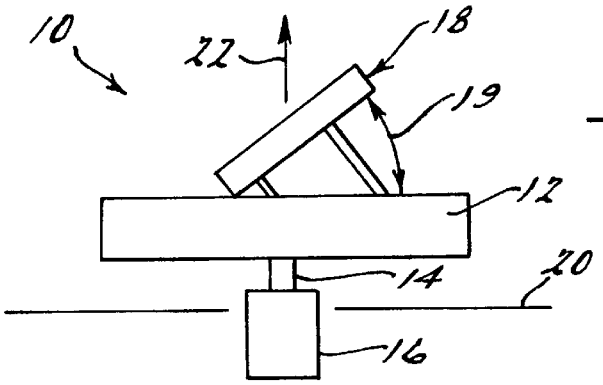
FIG. 1.
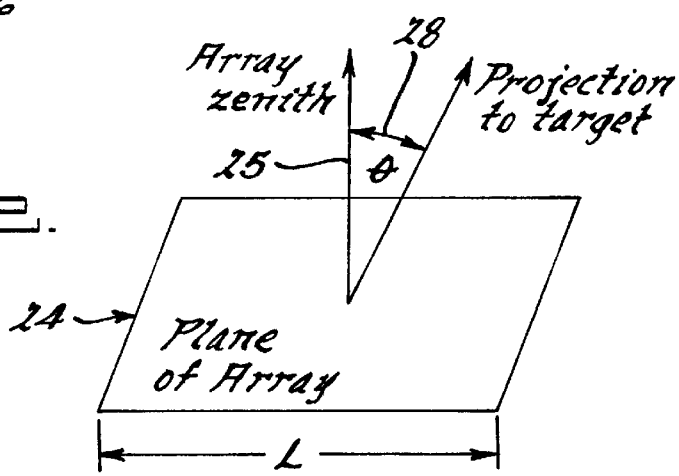
FIG. 2.
FIG. 3.
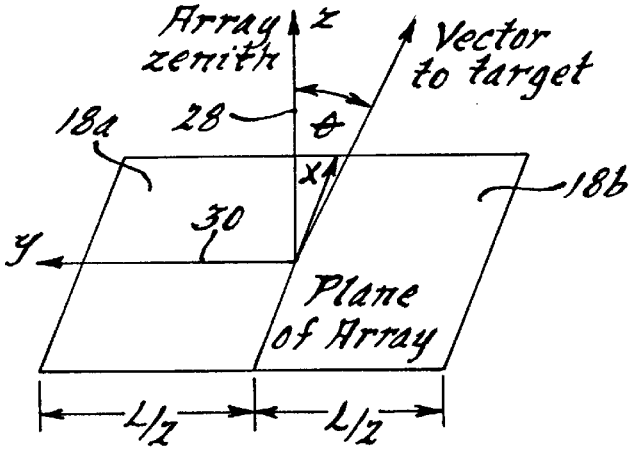
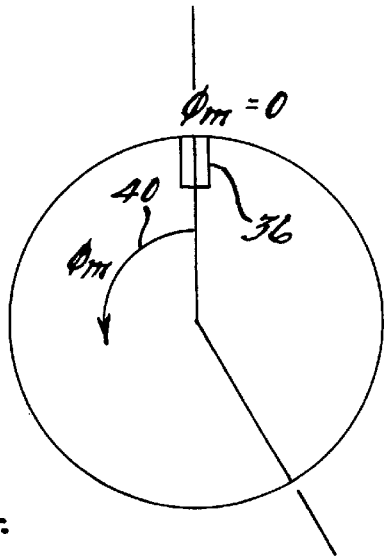
FIG. 4.

METHOD FOR MAINTAINING INSTANTANEOUS BANDWIDTH FOR A SEGMENTED, MECHANICALLY AUGMENTED PHASED ARRAY ANTENNA

TECHNICAL FIELD

This invention relates to phased array antennas, and more particularly to a method for positioning a phased array antenna disposed on a rotatable platform, which is in turn disposed on a moving platform such as an aircraft, such that the antenna can be pointed as needed to track a desired target such as a satellite-based radio frequency transponder.

BACKGROUND OF THE INVENTION

Electronically scanned phased array antennas typically exhibit superior tracking of a target, such as a satellite, when compared with purely mechanical dish antennas or single-axis electronically scanned phased array antennas. However, phased array antennas generally lose performance rapidly as the elevation angle above the plane of the array drops below about 30°. This can pose a difficulty in tracking a target such as a satellite-based RF transponder, when the antenna is mounted on a relatively fast moving mobile platform such as a jet aircraft. Depending upon the location of the aircraft relative to the geostationary arc of the satellite-based RF transponder being tracked by the aircraft's antenna, the elevation angle may drop below about 30° at one or more times during travel of the aircraft, thus causing a degradation in antenna performance and, at the worst case, loss of the signal being received from the satellite-based RF transponder.

Accordingly, it would be highly desirable to be able to mechanically move (i.e., rotate) an electronically scanned phased array antenna employed on a moving platform, as needed, to ensure that the antenna is positioned at all times to maintain the elevation angle of the beam of the antenna such that the elevation angle never drops below a predetermined lower limit.

Rotating the antenna whenever needed to maintain the scan angle greater than 30° (or other predetermined limit) would obviously require a significant number of positioning adjustments to the antenna when the antenna is used with a relatively fast moving platform such as a jet aircraft, which can cover a large distance in a relatively short time. Rotating the antenna as often as needed to maintain the elevation angle of the antenna beam to within a predetermined range could therefore result in excessive use of the apparatus used to reposition the antenna (i.e., most likely a motor) and premature mechanical failure of the apparatus.

It is therefore a principal object of the present invention to provide an apparatus and method for positioning a planar, electronically scanned, phased array antenna disposed on a moving platform such that the antenna can be rotationally positioned as needed during operation of the moving platform to maintain the elevation angle of the beam of the antenna within a predetermined range. In this manner, antenna performance can be maintained even if the moving platform would otherwise traverse a route that would cause the scann angle of its phased array antenna to drop below the predetermined lower limit.

It is still another object of the present invention to provide an apparatus and method for controlling movement of a planar, electronically scanned, phased array antenna used on a moving platform, and which is disposed on a movable support, in a manner which limits the frequency of incremental movement of the support. In this manner, wear and tear on the mechanism used for rotating the support can be significantly reduced while maintaining the scan angle of the antenna beam within a predetermined limit.

SUMMARY OF THE INVENTION

The above and other objects are provided by a method and apparatus in accordance with preferred embodiments of the present invention. The present invention is directed broadly to placement of a planar, electronically scanned, phased array antenna on a rotatable support and controlling rotational movement of the support as needed to maintain an elevation angle of the beam of the antenna at or above a minimum predetermined elevation angle, and while limiting movement of the support in a manner to reduce wear and tear on the mechanism used to rotate the support.

In one preferred form, the method of the present invention involves determining a maximum scan angle for the beam of the antenna, which is not to be exceeded, in order to maintain a desired bandwidth of the antenna at a given wavelength. The scan angle of the antenna beam is monitored during movement of the moving platform and, if the monitored scan angle exceeds the predetermined maximum scan angle, then the support is rotated in a direction necessary to point the antenna relative to the target being tracked (i.e., typically a satellite-based RF transponder) to cause the actual scan angle to be reduced below the maximum scan angle. The support for supporting the antenna is divided into a plurality of rotational positions, and preferably a plurality of evenly spaced apart rotational positions. Each rotational position is separated by a degree range which is determined such that movement of the rotational support from a given position to its next rotationally adjacent position causes the scan angle of the antenna to be reduced to a point below the maximum scan angle. In one preferred embodiment, the spaced apart rotational positions are spaced apart by no more than about 24°. The number of distinct rotational positions is also preferably limited to a relatively small plurality of positions, and in one preferred embodiment no more than about 20 such rotational positions, to which the support can be rotated.

In one preferred form of the present invention in which a dual element, electronically scanned phased array antenna is incorporated, the maximum scanned angle is determined by first determining the true-time-delay (TTD) increment between the elements of the antenna. This TTD increment is then used to determine the maximum scan angle. The direction of rotation of the support (i.e., either clockwise or counterclockwise) is determined by the sign of the azimuth angle of the antenna.

The method of the present invention accomplishes repositioning of the antenna periodically as needed to maintain the scan angle of the antenna below the maximum predetermined scan angle, and further with a minimum number of incremental position changes of the support. This significantly reduces wear and tear on the mechanism used to rotate the support and enhances reliability of such a system.

BRIEF DESCRIPTION OF THE DRAWINGS

The various advantages of the present invention will become apparent to one skilled in the art by reading the following specification and sub-joined claims and by referencing the following drawings in which:

FIG. 1 is a highly simplified side view of an electronically scanned phased array antenna mounted on a support, wherein the support is coupled to an output shaft of motor used to rotate the support;

FIG. 2 shows a highly simplified representation of the antenna of FIG. 1 illustrating the scan angle measurement;

FIG. 3 is a highly simplified representation of a dual element, electronically scanned, phased array antenna illustrating the scan angle; and FIG. 4 is a simplified representation of the support illustrating how initialization of the position of the support is accomplished.

DETAILED DESCRIPTION OF THE PREFERRED EMBODIMENTS

Referring to FIG. 1, an apparatus 10 in accordance with the present invention is illustrated. The apparatus 10 generally includes a support 12 which is rotatable by movement of an output shaft 14 of a motor 16. Fixedly disposed on the support 12 is an electronically scanned, phased array antenna 18. The motor 16 and support 12 are disposed on a surface of a moving platform 20 which may comprise an aircraft, watercraft or any other form of moving platform. The antenna 18 is tilted up from the horizontal at a tilt angle 19 of preferably about 30°–60°, and more preferably about 450, relative to the support 12. The motor 16 causes the support 12, and thus the antenna 18, to be rotated about a vertical axis 22 as needed to maintain a scan angle (θ) of the antenna 18 within a predetermined degree range.

The importance of maintaining the scan angle (θ) within a predetermined range can be explained with reference to FIG. 2. FIG. 2 shows a highly simplified representation of an electronically scanned, phased array antenna 24. The scan angle (θ) is the angle 28 between the vector 26 extending normal to the surface of the antenna 24 and the antenna beam when the beam is projected to the target. Such electronically scanned, phased array antennas are well known to exhibit limitations in their ability to focus a beam at an angle close to the horizon of the Earth. Such limitations include increased interference from grating lobes as well as loss of instantaneous bandwidth due to beam "squint" (pointing at slightly different angles as a function of frequency). The scan angle (θ) 28 is therefore the angle of the projected antenna beam from the array zenith (vector 25 in FIG. 2). The scan angle (θ) can thus be expressed as an angle equal to 90° minus the elevation angle of the beam. The scan angle (θ) is related to the half-power instantaneous bandwidth by the formula:

$$\frac{\Delta f}{f} = k\left(\frac{\lambda}{L\sin\theta}\right)$$

where: "k" is a constant near 1;

λ is the center wavelength;

"L" is the array size; and

Δ f/f is the instantaneous fractional bandwidth.

As the scan angle (θ) gets larger (i.e., the antenna beam points more toward the plane of the phased array antenna), the fractional bandwidth decreases for a constant array size and wavelength. Thus, to maintain the scan angle (θ) within a predetermined degree range, it becomes necessary to physically turn the entire array rotationally such that the scan angle (θ) does not exceed a predetermined maximum scan angle, if the bandwidth of the antenna is to be prevented from decreasing below a predetermined lower level at a given wavelength.

To maintain nominal (i.e, boresight) instantaneous bandwidth at higher scan angles, the array can be segmented into several "subarrays", each of which has a smaller total area (i.e., a reduced "L"), and which has the required instantaneous bandwidth. Such an array is shown in FIG. 3. FIG. 3 shows the antenna 18 divided into two subarrays 18*a* and 18*b*. The outputs from the subarrays 18*a*, 18*b* are adjusted using true-time-delays between them. This preserves the instantaneous bandwidth across the subarrays 18*a* and 18*b*.

The true-time-delay value can also be combined with the adjustment of the support 12 by setting the latter to be identical to that used for setting the true time delay. For the antenna of FIG. 3, the maximum desired scan angle can be determined to be 14° from boresight, where boresight is represented by vector 28 in FIG. 3, in the direction connecting the two subarrays (i.e., the Y-axis) denoted by vector 30. The precise maximum scan angle (θ) can be calculated assuming a given minimum true time delay increment of 161 picoseconds (equivalent to about 1.9 inch (4.82 cm) of free space length at the speed of light) and a subarray separation of 8 inches (20,32 cm), such that the scan angle (θ) threshold is:

$$\theta = \arcsin\left(\frac{8}{1.9}\right) = 13.7^\circ \text{ degrees}$$

The above-mentioned scan angle threshold can then be converted into an antenna intermodule phase difference threshold (in the direction of Y axis 30 in FIG. 3) and yields:

$$\delta_y = 2\pi\frac{\Delta_y}{\lambda}\cdot\sin(\theta)\sin(\phi) \text{ radians,}$$

where: $\Delta_y$ is the antenna module spacing in the Y-direction (0.133096 meters) and ϕ is the azimuth angle (i.e., the rotation of the antenna beam projection in the plane from the x-axis, wherein the x-axis is denoted by reference numeral 32 in FIG. 3).

This yields a rotation criterion of 0.84 radians for a frequency of 12.45 GHz. Thus, whenever the absolute value of the calculated intermodule phase exceeds 0.84, the support 12 should be rotated by the motor 16.

When attempting to maintain the actual scan angle (θ) of the antenna beam below a predetermined maximum scan angle value, three items must be determined:

1) when to adjust the mechanical support 12;

2) how much to adjust the mechanical support 12; and 3) in which direction to adjust the mechanical support 12.

These factors are also related to one another.

The first item has already been described. The support 12 is adjusted when the scan angle is determined to have exceeded approximately 13.7°. The second item (i.e., the degree of rotational adjustment needed) is related to the first consideration, with certain additional considerations. One such additional consideration is the importance of maintaining an absolute location of the support 12 so that prior satellite-based transponder locations within the coverage region can be recovered by the antenna system 10. This requires that the size of the rotation increment of the support 12 be an integer function of one rotation. Another important consideration is that the size of the selected increment must provide stability. Put differently, whenever the support 12 is rotated, the resulting scan angle (θ) should be less than the scan angle prior to the rotation. Finally, some tolerance must be allowed for potential inaccuracies in the movement of the support 12.

Using the second criteria enumerated above, the rotation increment of the support 12 must be less than twice the maximum scan angle (2×14°=28°). When considering the first and second criteria described above, the allowable number of rotational positions (i.e., sectors) and the spacing between the positions (in degrees) can be set forth as follows:

| Number of sectors | Rotation increment (degrees) |
|---|---|
| 15 | 24 |
| 16 | 22.5 |
| 18 | 20 |
| 20 | 18 |

Subtracting five degrees error tolerance (the last criterion described above) from the maximum value of the increment yields 28−5=23°. Therefore, the largest rotational increment that is stable and yields discrete support positions is approximately 22.5°.

The direction of rotation of the support 12 is always in the direction to reduce the scan angle (θ). If the absolute value of the intermodule phase difference exceeds the threshold and sin(ϕ) is positive, the rotation would be counterclockwise using the diagram of FIG. 4. If the absolute value of the intermodule phase difference exceeds the threshold but sin(ϕ) is negative, the rotation would be clockwise.

With further reference to FIG. 4, the initialization of the support 12 will be described further. In FIG. 4 the support 12 is represented in highly simplified form. A position detector 36 disposed at the location $\phi_m$=0. Assume that the support 12 rotates continuously during initialization with no stops.

Upon initialization, the support 12 is commanded to rotate clockwise in the drawing of FIG. 4, thus decreasing $\phi_m$ until the position sensor 36 is sensed. This detection can be accomplished optically, magnetically or by any other suitable detection means. This position can be defined as $\phi_{m0}$.

Acquisition of a satellite-based transponder may begin by using the inertial reference unit (IRU) of the mobile platform 20 and by rotating the support 12 to a stored value of $\phi_m$ in increments of 22.5°. The antenna 18 is then electronically pointed to $\theta_{pa}$ and $\phi_{pa}$, which are values stored in a control system (not shown) associated with the antenna system 10. The support 12 is then rotated sector by sector (i.e., in 22.5° increments) until the desired satellite-based transponder is acquired.

To begin acquisition of the satellite-based transponder without the benefit of an IRU, the turntable is initially positioned at $\phi_m$=0 as described above. The support 12 is then rotated sector by sector until the satellite is acquired.

During tracking two criteria will cause the support 12 to rotate. For typical operation in a single hemisphere (North or South), applying the true-time-delay change criteria ensures that the transit time of a wavefront between the two subarrays never exceeds the value which causes the bandwidth of the antenna 18 to drop below approximately 500 MHz. This criteria causes the turntable to rotate one sector (22.5°).

For flights which operate across the equator near the sub-satellite point (i.e., underneath the geostationary orbital position of the satellite transponder being tracked), the satellite transponder appears to go directly overhead, thus potentially causing the scan angle to exceed, nominally, 45° (90°—tilt angle of the antenna 18). As the mobile platform 20 (in this example an aircraft) transits the equator, the scan angle increases beyond 45°, at which point the support 12 must be rotated 180°. The actual value of the threshold should allow for nominal cruise roll/pitch variations, which are approximately two degrees. Thus, at a position of 92° minus the antenna tilt angle 18*a*, the support 12 should rotate 180°. The direction of the rotation is given by the sign of the electronically sensed azimuth angle (angle 40) in the diagram shown in FIG. 4. The support 12 is rotated clockwise, which causes $\phi_m$ to be decremented, if $\phi_{pa}$ is negative. The support is rotated counterclockwise, causing $\phi_m$ to be incremented, if $\phi_{pa}$ is positive. It is strongly preferred that no adjustment criteria be evaluated while the support 12 is moving because all values are transient. Whenever $\phi_m$ is incremented or decremented, a running status of $\phi_m$ is maintained so that a commanded change to a new location can be quickly implemented without reinitializing the antenna 20.

When the antenna is to be commanded to a new location, longitude information of the new satellite to be tracked is received by the control systems (not shown) associated with the motor 16. Next, the scan angle required to acquire the new satellite is determined along with the appropriate azimuth angle (ϕ) (i.e., the total azimuth angle including movement of the support 12). Next, the azimuth angle of the support ($\phi_m$) is determined such that $$\delta_y = 2\pi\frac{\Delta_y}{\lambda}\cdot\sin(\theta)\sin(\phi)\text{ radians,}$$

As explained above, the increment may vary, but in the preferred method is approximately 22.5°.

The final step is rotating the support 12 to the newly determined azimuthal position ($\phi_m$), calculating $\theta_{pa}$ and $\phi_{pa}$ and electronically steering the antenna in accordance with these values.

The following chart summarizes the limited number of antenna azimuth changes that would be required during various routes of travel of an aircraft:

| Start Location | End Location | Satellite Location° East Long | Max Latitude° | Max Total Scan° | Max Electronic Scan° | # of Incremental Antenna Movements |
|---|---|---|---|---|---|---|
| Seattle | Boston | −101.1 | 48.5 | 59.4 | 16.6 | 1 |
| Seattle | Rio de Janeiro | −61.5 | 47.6 | 82.3 | 46.1 | 1 |
| Seattle | London | −61.5 | 67.7 | 80.6 | 37.2 | 2 |
| Seattle | Johannesburg | −61.5 | 55.1 | 96.2 | 51.5 | 4 |
| Seattle | Tokyo | −175 | 54.6 | 75.8 | 31.6 | 1 |
| Seattle | Sydney | −175 | 47.6 | 77.3 | 45.9 | 1 |
| London | Tokyo | 72 | 70.9 | 88.5 | 43.7 | 1 |
| London | New | 39 | 52.1 | 71.0 | 26.7 | 2 |

-continued

| Start Location | End Location | Satellite Location° East Long | Max Latitude° | Max Total Scan° | Max Electronic Scan° | # of Incremental Antenna Movements |
|---|---|---|---|---|---|---|
| | Delhi | | | | | |
| Seattle | Beijing | −175 | 63.1 | 81.2 | 36.2 | 2 |
| Seattle | Moscow | 45 | 82.2 | 94.1 | 49.6 | 0 |

In the above chart, "Max Total Scan" represents the angle between the support 12 axis of rotation and the projection to the satellite.

The system and method of the present invention thus provides a means for determining and controlling movement of a mechanically rotatable support on which is mounted an electronically scanned phased array antenna, and controlling movement of the support to minimize the number of position adjustments of the support needed to cause the antenna to track a target during movement of a mobile platform on which the antenna is mounted. The present invention therefore significantly reduces the wear and tear on the motor required to rotate the support.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and the following claims.

What is claimed is:

1. A method for positioning an electronically scanned phased array antenna disposed on a rotatable support in real time, wherein the support is disposed on a moving platform, as said antenna tracks a radio frequency transponder fixed in position relative to the Earth, to maintain an actual scan angle of a beam of said antenna within a predetermined scan angle range necessary to maintain a desired bandwidth of said antenna at a given wavelength, said method comprising the steps of:

determining a maximum scan angle not to be exceeded in order to maintain said desired bandwidth when said antenna is being scanned to track said transponder while said support is being held stationary;

defining a rotational path of movement of said antenna to include a plurality of generally evenly spaced apart locations to which said support can be rotated, with a distance between adjacent ones of said locations being determined so as to result in a change in magnitude of less than about twice that of said predetermined maximum scan angle;

monitoring said actual scan angle of said antenna during movement of said moving platform and, if said actual scan angle exceeds said predetermined maximum scan angle, rotating said support to a next adjacent one of said locations and in a direction necessary to point said antenna relative to said transponder to cause said actual scan angle to be reduced in magnitude below said maximum scan angle.

2. The method of claim 1, further comprising the step of initializing said support to determine a reference position of said support.

3. The method of claim 1, wherein the step of rotating said support by a fixed increment of movement comprises moving the support by a value of no more than approximately 24 degrees.

4. The method of claim 1, further comprising the step of segmenting said movement of said support into no more than 20 distinct rotational positions to which said support can be rotated.

5. A method for positioning an electronically scanned phased array antenna disposed on a rotatable support in real time, wherein the support is disposed on a moving platform, as said antenna tracks a space-based radio frequency transponder, to maintain an actual scan angle of a beam of said antenna within a predetermined scan angle range necessary to maintain a desired bandwidth of said antenna at a given wavelength, said method comprising the steps of:

providing a dual element, electronically scanned phased array antenna;

determining a true-time-delay (TTD) increment between said dual elements of said electronically scanned phased array antenna and using said increment to determine a maximum scan angle not to be exceeded in order to maintain said desired bandwidth; and monitoring said actual scan angle during movement of said moving platform and, if said actual scan angle exceeds said predetermined maximum scan angle, rotating said support in a direction necessary to cause said actual scan angle to be reduced in magnitude below said maximum scan angle.

6. The method of claim 5, further comprising the step of:

determining a fixed increment of movement by which said support is to be rotated.

7. The method of claim 6, further comprising the step of:

when said actual scan angle exceeds said maximum predetermined scan angle, causing said support to be rotated by a number of degrees that is less than twice said maximum scan angle.

8. The method of claim 6, wherein the step of determining said maximum scan angle comprises setting said maximum scan angle to approximately 14 degrees; and wherein the step of determining said fixed increment of movement comprises setting said fixed increment of movement to a value less than approximately 24 degrees.

9. The method of claim 5, further comprising the step of determining whether to rotate said support clockwise or counterclockwise when it is determined that said actual scan angle has exceeded said maximum scan angle.

10. A method for positioning an electronically scanned phased array antenna disposed on a rotatable support in real time, wherein the support is disposed on a moving platform, as said antenna tracks a space-based radio frequency transponder, to maintain an actual scan angle of a beam of said antenna within a predetermined scan angle range necessary to maintain a desired bandwidth of said antenna at a given wavelength, said method comprising the steps of:

providing a dual element, electronically scanned phased array antenna;

determining a true-time-delay (TTD) increment between said dual elements of said electronically scanned phased array antenna and using said increment to determine a maximum scan angle not to be exceeded in order to maintain said desired bandwidth;

segmenting movement of said support into a plurality of distinct rotational positions to which said support can be rotated, said plurality of distinct rotational positions being selected based upon said maximum desired scan angle;

monitoring said actual scan angle during movement of said moving platform;

comparing said actual scan angle to said predetermined maximum scan angle;

if said actual scan angle exceeds said predetermined maximum scan angle, rotating said support to one of said distinct rotational positions immediately adjacent its present said rotational position to cause said actual scan angle to be reduced in magnitude below said maximum scan angle.

11. The method of claim 10, wherein the step of determining said maximum scan angle comprises setting said maximum scan angle at approximately 14 degrees.

12. The method of claim 10, wherein the step of segmenting movement of said support into a plurality of distinct rotational positions comprises the step of segmenting movement of said support into no more than 20 distinct rotational positions.

13. The method of claim 10, further comprising the step of initializing said support to establish a reference position of said support.

14. A method for positioning an electronically scanned phased array antenna disposed on a rotatable support to thus cause said antenna to track a desired target, wherein the support is disposed on a moving platform, to thereby maintain an actual scan angle of a beam of said antenna within a predetermined scan angle range necessary to maintain a desired bandwidth of said antenna at a given wavelength, said method comprising the steps of:

determining a maximum scan angle not to be exceeded in order to maintain said desired bandwidth;

segmenting rotational movement of said support into a plurality of distinct, evenly spaced apart rotational positions to which said support can be rotated, wherein said plurality of rotational positions selected does not exceed by a factor of two said determined maximum scan angle; and monitoring said actual scan angle of said antenna during movement of said moving platform and, if said actual scan angle exceeds said predetermined maximum scan angle, rotating said support in a direction necessary to point said antenna relative to said desired target to cause said actual scan angle to be reduced in magnitude below said maximum scan angle.

15. The method of claim 14, wherein said step of determining said maximum scan angle comprises the step of setting said maximum scan angle to approximately 14 degrees.

16. The method of claim 14, wherein the step of segmenting rotational movement of said support into said plurality of distinct rotational positions comprises the step of segmenting movement of said support into evenly spaced apart rotational positions spaced at least approximately 18 degrees apart from one another.

* * * * *

UNITED STATES PATENT AND TRADEMARK OFFICE

CERTIFICATE OF CORRECTION

PATENT NO. : 6,356,239 B1
DATED : March 12, 2002
INVENTOR(S) : Ronald Steven Carson It is certified that error appears in the above-identified patent and that said Letters Patent is hereby corrected as shown below:

Column 3,
Line 22, “19” should be -- 19A --
Line 23, “450” should be -- 45º --

Column 4,
Line 8, “12” should be -- 14 --
Line 18, “20,32” should be -- 20.32 --*

Signed and Sealed this

Thirty-first Day of December, 2002

JAMES E. ROGAN
*Director of the United States Patent and Trademark Office*